US005430989A

United States Patent [19]

Jones

[11] Patent Number: 5,430,989

[45] Date of Patent: Jul. 11, 1995

[54] CONSTRUCTION SYSTEM

[76] Inventor: Richard H. Jones, 2709 Fleming St., Alexandria, Va. 22306-1625

[21] Appl. No.: 203,572

[22] Filed: Mar. 1, 1994

[51] Int. Cl.[6] ..... E04H 12/22

[52] U.S. Cl. ..... 52/655.1; 52/81.3; 52/648.1; 52/652.1; 52/653.1; 52/655.2; 403/171; 403/176; 403/217; 446/122; 446/126

[58] Field of Search ..... 403/171, 176, 217; 52/81.1, 81.3, 648.1, 652.1, 653.1, 655.1, 655.2; 446/104, 122, 124, 125, 126

[56] References Cited

U.S. PATENT DOCUMENTS

| | | | |
|---|---|---|---|
| 1,198,263 | 8/1916 | Pajeau . | |
| 1,915,835 | 6/1933 | Pajeau . | |
| 2,682,235 | 6/1954 | Fuller . | |
| 2,986,241 | 5/1961 | Fuller . | |
| 3,521,421 | 7/1970 | Schroeder, Jr. . | |
| 3,974,600 | 8/1976 | Pearce . | |
| 4,065,220 | 12/1977 | Ruga . | |
| 4,136,984 | 1/1979 | Hayashi . | |
| 4,521,998 | 6/1985 | DeLorme . | |
| 4,580,922 | 4/1986 | Coppa | 403/176 X |
| 4,650,361 | 3/1987 | Seuster . | |
| 4,904,108 | 2/1990 | Wendel . | |
| 4,982,546 | 1/1991 | Lange | 52/655.2 X |
| 5,049,105 | 9/1991 | Glickman . | |
| 5,127,759 | 7/1992 | Orbom | 403/171 |
| 5,155,951 | 10/1992 | Lalvani . | |
| 5,161,344 | 11/1992 | Kahonen | 403/176 X |

FOREIGN PATENT DOCUMENTS

| | | | |
|---|---|---|---|
| 85643 | of 1965 | France | 403/171 |
| 617011 | 8/1935 | Germany | 446/104 |
| 589940 | 3/1959 | Italy . | |
| 893983 | 4/1962 | United Kingdom . | |
| 2244536 | 12/1991 | United Kingdom | 403/171 |

*Primary Examiner*—Carl D. Friedman
*Assistant Examiner*—Christopher Todd Kent
*Attorney, Agent, or Firm*—Bacon & Thomas

[57] ABSTRACT

A construction system for making latticework structures comprising connectors and rods. Each connector has a base portion with at least two side portions and opposing faces. A first attaching element is attached to a first side portion of the base portion. Second and third attaching elements are secured in axial alignment at spaced locations to a second side portion of the base portion. Respective connectors can be interconnected to each other by placing the first attaching element of one connector between the second and third axially aligned attaching elements of another connector and passing a rod through aligned receiving openings in each of the first, second and third attaching elements. Many of these connectors and rods may be assembled to form larger structures such as cubes, pyramids and other polyhedrons. The connectors themselves may take various shapes such as triangles, sectors and trapezoids.

20 Claims, 8 Drawing Sheets

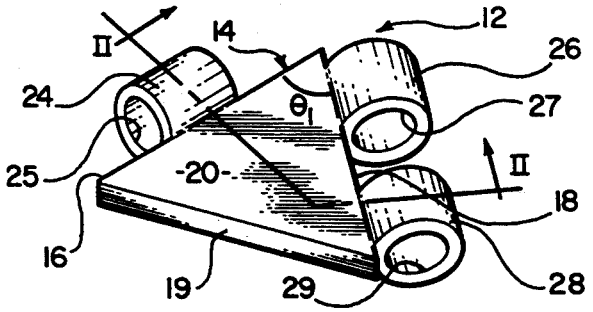
FIG. 1
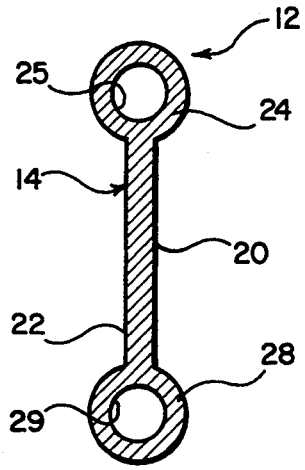
FIG. 2
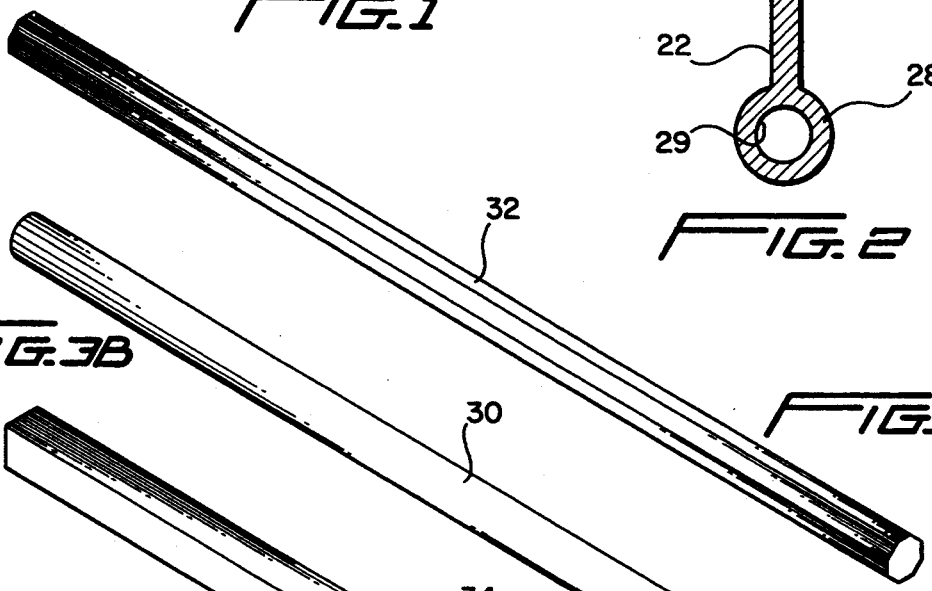
FIG. 3B
FIG. 3A
FIG. 3C
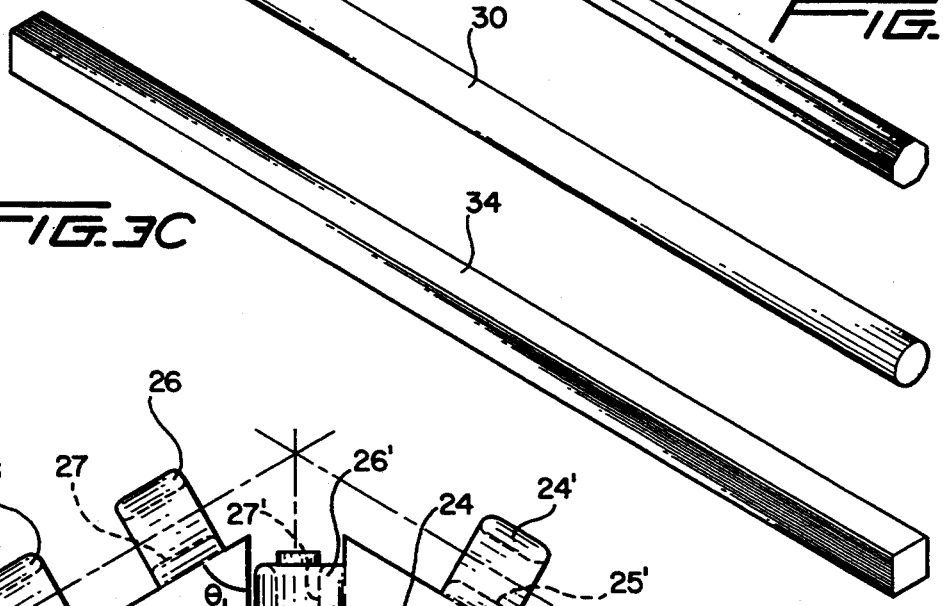
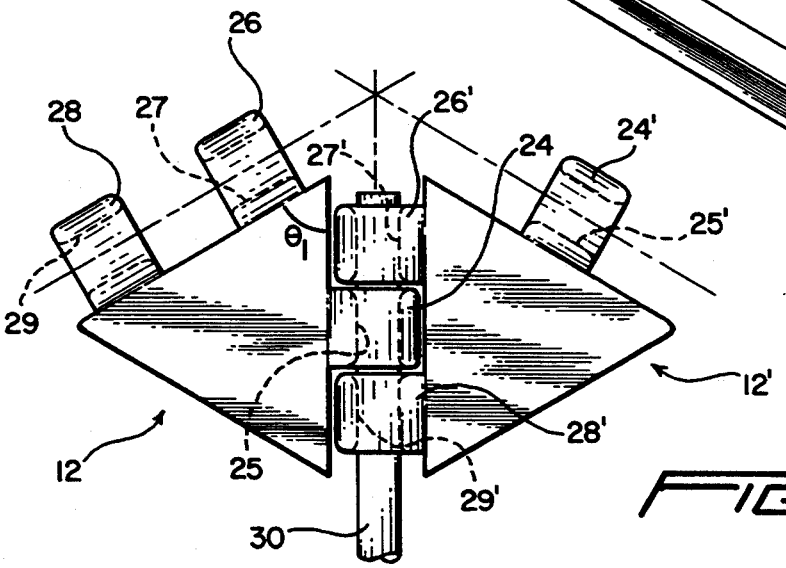
FIG. 4

CONSTRUCTION SYSTEM

BACKGROUND OF THE INVENTION

1. Field of the Invention

The present invention generally pertains to the art of construction systems and, more particularly, to a construction system constituted by connectors and rods which can be interconnected to form various latticework structures.

2. Discussion of Prior Art

Construction systems using rods and connectors to form latticework structures are generally known in the prior art. These structures are generally created by interconnecting the ends of elongated rods to form a rigid frame. Examples of such structures include oil derricks, antenna towers, bridges and tressels.

Much of the prior art describes the methodology of constructing buildings. For example, U.S. Pat. No. 2,682,235 to Fuller discloses a geodesic dome formed from a number of struts which are interconnected by connectors. These struts and connectors are assembled into triangles which are then interconnected to form the dome. U.S. Pat. No. 2,986,241 discloses a building made using a strut and connector construction system. U.S. Pat. Nos. 3,974,600 and 5,155,951 describe how special classes of framework elements can be used to create certain types of building structures. In essence, these patents disclose using rods and connectors to make modular frame units such as triangles or polyhedrons. These modular shapes are then combined to form an overall building. Unfortunately, none of these patents disclose an inexpensive way of connecting the rods in a quick and efficient manner without the need for complex tools.

It is also known in the prior art to use connectors and rods to create toy construction sets. U.S. Pat. Nos. 1,113,371, 1,198,263 and 1,915,835 to Pajeau and U.S. Pat. No. 5,049,105 to Glickman exemplify such toy construction sets. It will be noted from observing the aforementioned patents that these patents disclose construction systems in which rod members are connected to and extend radially outward from a hub. They are limited in that all the connecting rods except one must be in a single plane. These construction sets therefore have limited application.

Several prior art patents disclose the specific structure of joining a hub to a rod. In general, these patents describe connector and rod assemblies which can be used to make many of the structures discussed above. However, it should be noted that the combination of a high degree of specialization, the relatively complex design and the difficulty of fabricating these patented connectors has evidently mitigated against their commercial success. For example, U.S. Pat. No. 4,521,998 discloses a universal hub specifically designed for geodesic type structures. U.S. Pat. No. 4,650,361 discloses a joint specifically adapted to attach reflector panels to a truss support structure of a radio telescope. U.S. Pat. Nos. 4,065,220 and 4,904,108 each disclose connectors for a construction system which are rather complex in shape and require the machining of numerous sockets at angles carefully calculated in three dimensions. Obviously, these factors add great expense in the overall manufacturing of these connectors.

U.S. Pat. Nos. 3,521,421 and 4,136,948 each disclose connectors for joining tubular members. It should be noted that while U.S. Pat. No. 3,521,421 does disclose an adjustable connector which can create a lattice, this patent does not disclose a system in which it is possible to combine several connectors to form a single rigid joint. In addition, three or more connectors of the art disclosed in U.S. Pat. No. 3,521,421 can be combined with one another in a single joint only when adjusted identically. This severely limits the possible applications of the connectors. The connection arrangement in U.S. Pat. No. 4,136,984 suffers from a similar problem. Actually, it is not possible to combine two or more of the connectors disclosed in U.S. Pat. No. 4,136,948 to form a single rigid joint. Rather, this prior art patent teaches providing a rigid, integrally formed connector for each joint that is desired. Creating a separate, rigid and integrally formed connector for each joint unduly adds to the expense associated with such a system.

Based on the above discussion, it should be readily apparent that there exists a need in the art for a construction system composed of a relatively few number of connector pieces that can be inexpensively manufactured and yet can be interconnected to form a wide variety of latticework structures.

SUMMARY OF THE INVENTION

It is an object of the present invention to provide a construction system made up of a collection of extremely simple connector elements which can be fabricated inexpensively but which can be easily interconnected by rods in order to form various latticework structures.

It is another object of the invention to provide a construction system comprised of connector elements from a relatively small set of sizes that can be interconnected by means of rods in a variety of ways so as to create a wide range of complex joints for latticework structures.

These and other objects of this invention are realized by providing a construction system made up of a plurality of varying sized connectors that are adapted to be interconnected by rods. Each of the connectors comprises a base portion having opposing faces and various side portions. Attaching elements of preferably cylindrical cross-section are mounted on respective side portions of the base portion. Each of the attaching elements defines a receiving opening that has an associated longitudinal axis, The longitudinal axes of the various receiving openings converge to a point spaced from the base portion. The rods may be inserted into the receiving openings of aligned attaching elements thus forming a joint. Several of these connectors and rods can be interconnected to form relatively large structures.

Other objects, features and advantages of the invention shall become more readily apparent from the following detailed description of a preferred embodiment thereof, when taken in conjunction with the drawings wherein like reference characters refer to corresponding parts in the several views.

BRIEF DESCRIPTION OF THE DRAWINGS

FIG. 1 is a perspective view of a first connector embodiment incorporated in the construction system of the present invention;

FIG. 2 is a cross-sectional view generally taken along line II—II of FIG. 1;

FIGS. 3A through 3C show perspective views of connecting rods of varying cross-sections usable in the construction system of the invention;

FIG. 4 is a plan view of two connectors, constructed in the manner shown in FIG. 1, assembled together with a connecting rod;

DETAILED DESCRIPTION OF THE PREFERRED EMBODIMENTS

Figure 5A:
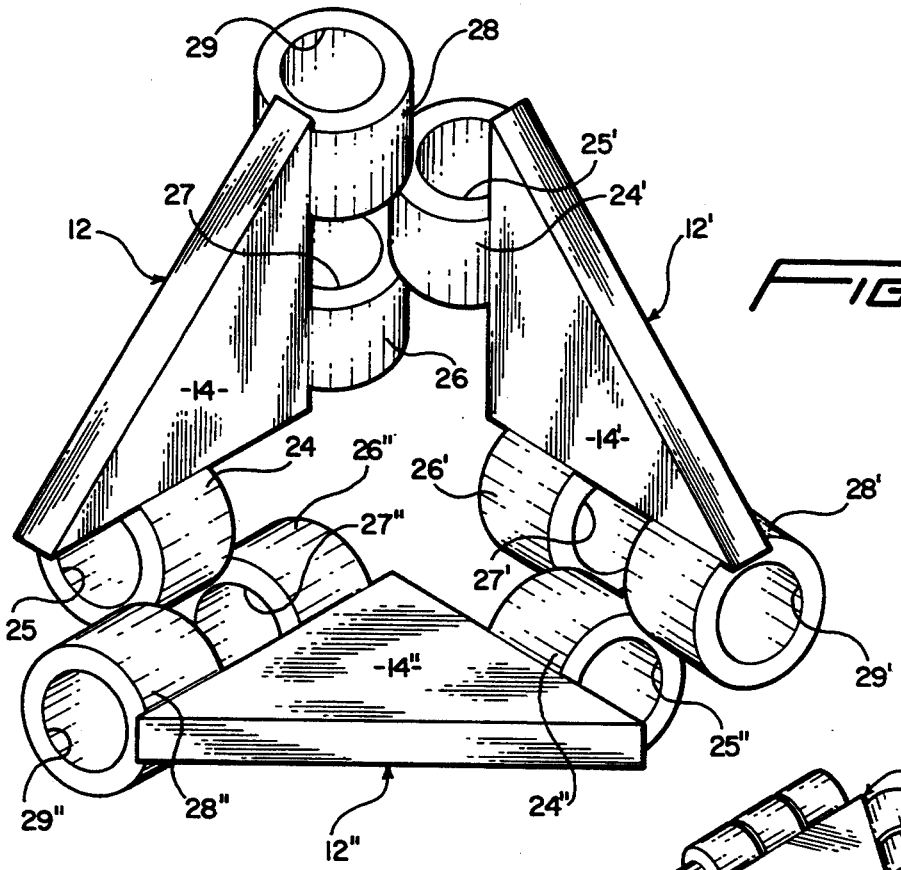
FIG. 5A is an exploded perspective view of three partially assembled, interlocking connectors constructed in a manner illustrated in FIGS. 1 and 2.

With initial reference to FIGS. 1 and 2, a first connector incorporated in the construction system of the present invention is generally indicated at 12. Connector 12 comprises a base portion 14 having a first side portion 16, a second side portion 18 and a third side portion 19. In the preferred embodiment of connector 12, first and second side portions 16 and 18 converge to define an angle $\theta_1$ equalling 60°. In addition, base portion 14 has opposing faces 20 and 22 as can best be seen in FIG. 2. A first attaching element 24 is attached to the first side portion 16 of the base member 14. In the preferred embodiment, attaching element 24 constitutes a tubular member having a receiving opening 25. A second attaching element 26, having a receiving opening 27, and a third attaching element 28, having an associated receiving opening 29, are attached to the second side portion 18 of base portion 14. In the preferred embodiment shown, attaching elements 26 and 28 also constitute tubular members. Attaching elements 26 and 28 are axially aligned and, as discussed more fully below, are spaced a distance slightly greater than the length of attaching element 24. As depicted, receiving openings 25, 27 and 29 are circular in cross-section so as to accommodate a circular rod such as that indicated at 30 in FIG. 3B. However, it should be understood that the specific geometry of receiving openings 25, 27 and 29, as well as attaching elements 24, 26 and 28 themselves, can be varied without departing from the spirit of the invention. For instance, these geometries could be such so as to accommodate various shaped rods such as those shown in FIGS. 3A–3C. For instance, a rod 32 with an octagon-shaped cross-section as shown in FIG. 3A or a rod 34 with a square cross-section as shown in FIG. 3C could be used. However, it should be noted, as will be more fully discussed below, that utilizing cylindrical rod 30 permits relative pivoting between multiple assembled connectors 12.

FIG. 4 depicts two connectors constructed in the manner shown in FIG. 1 assembled with a rod. More specifically, first connector 12 is interconnected with a second connector 12′ by means of rod 30. Since second connector 12′ is constructed identical to connector 12, a detailed description of its construction need not be repeated here. Instead, the same reference numerals utilized in detailing the construction of connector 12 have been utilized is referencing corresponding parts of connector 12′ with the inclusion of a prime.

To interconnect connectors 12 and 12′, attaching element 24 of connector 12 is positioned between attaching elements 26′ and 28′ of connector 12′ such that their respective receiving openings 25, 27′ and 29′ are axially aligned and rod 30 extends therethrough. In the preferred embodiment, attaching element 24 of connector 12 is adapted to fit snugly between attaching elements 26′ and 28′ such that connectors 12 and 12′ are prevented from sliding axially relative to each other. In addition, receiving openings 25, 27′ and 29′ have associated diameters which are only slightly greater than the diameter of rod 30 to prevent undesirable play in the joint created between connectors 12 and 12′. It should also be noted that the point at which the longitudinal axis defined by aligned receiving openings 27 and 29 intersects the longitudinal axis defined by receiving openings 25, 27′ and 29′ is coincident with the point of intersection of the longitudinal axis defined by receiving opening 25′ and receiving openings 25, 27′ and 29′. Connectors which satisfy this intersecting axes relationship can be readily interconnected to create a wide range of complex joints for latticework structures as will be emphasized more fully below. On the other hand, connectors whose axes fail to intersect in a single point, or zone depending upon allowable tolerances, can obviously not be combined to form a joint for connecting together a plurality of rods having a single converging vertex. Therefore, when utilizing a variety of differently sized connectors in accordance with the present invention, the physical dimensions of the connectors are preferably chosen so that they all satisfy this intersecting axes relationship. This greatly contributes to the versatility of the present construction system.

Figure 5B:
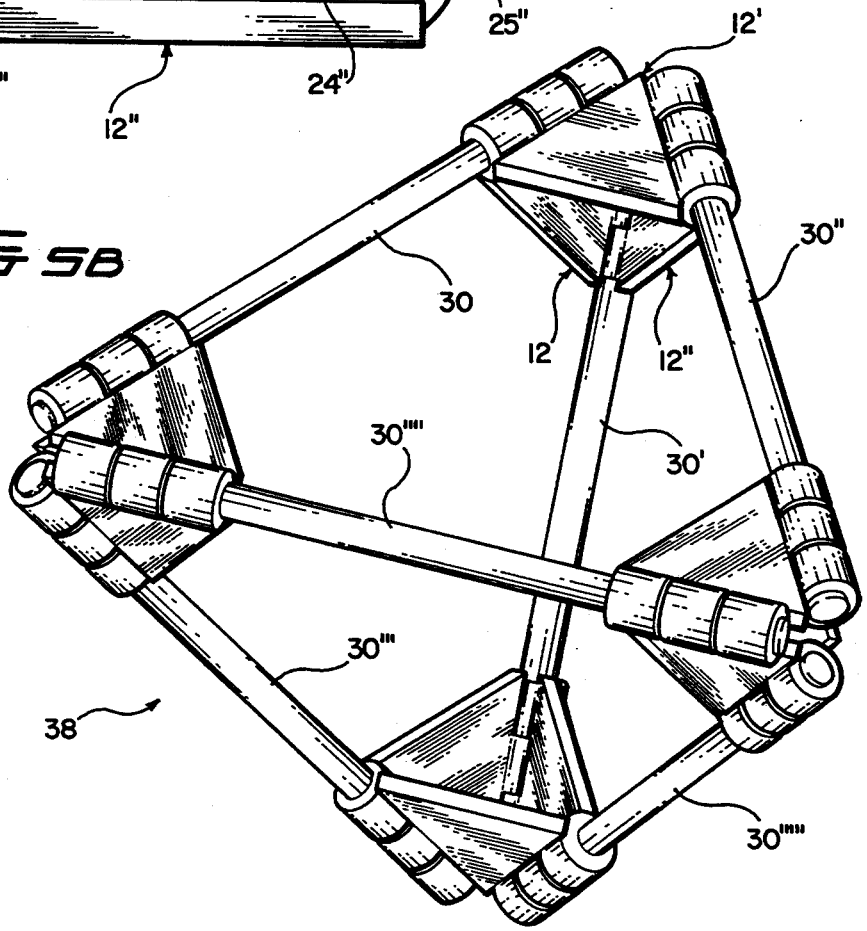
FIG. 5B depicts a perspective view of a tetrahedron constructed using the rods and connectors of FIGS. 1–5A.

Now referring to FIG. 5A, there is shown three connectors 12, 12' and 12'' in the process of being assembled into a corner piece or joint. As shown, the corner piece is formed by aligning the respective receiving openings of attaching elements 26, 24' and 28; 26'', 24 and 28''; and 26', 24'' and 28'. These aligned receiving openings can each receive a respective rod 30 to form the corner piece. This corner piece, along with three other corner pieces of similar construction, can be interconnected by respective connecting rods 30, 30', 30'', 30''', 30'''' and 30''''' in order to form the pyramid-shaped latticework structure 38 shown in FIG. 5B. Again, it should be noted that the group of rods 30, 30', and 30'' define longitudinal axes that intersect at a vertex remote from connectors 12, 12' and 12''. This holds true for the respective group of rods joined together at each corner joint.

Figure 6:
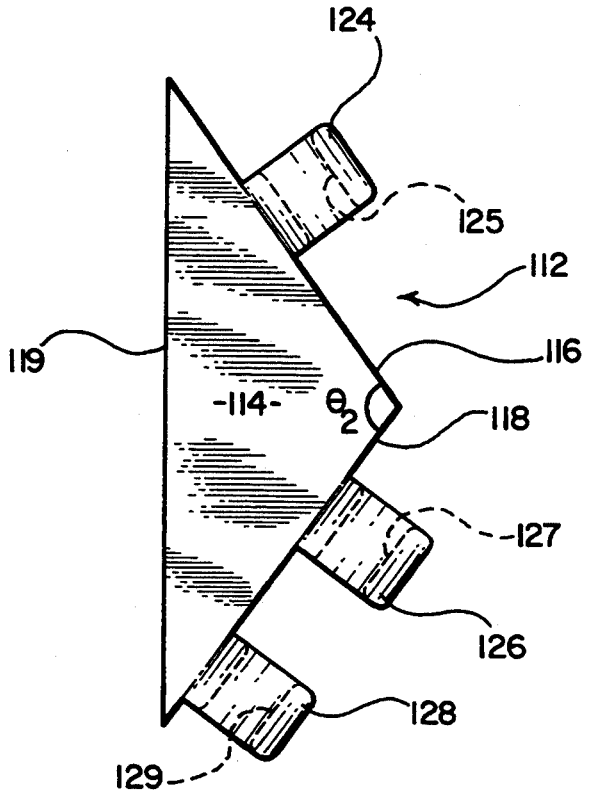
FIG. 6 is a plan view of a second connector embodiment incorporated in the construction system of the invention.

FIG. 6 depicts a second connector embodiment generally indicated at 112. Connector 112 includes a base member 114 having first, second and third side portions 116, 118 and 119, respectively. As illustrated, first and second side portions 116 and 118 converge to define an angle $\theta_2$. In the preferred embodiment of connector 112, angle $\theta_2$ equals 108°.

Figure 7A:
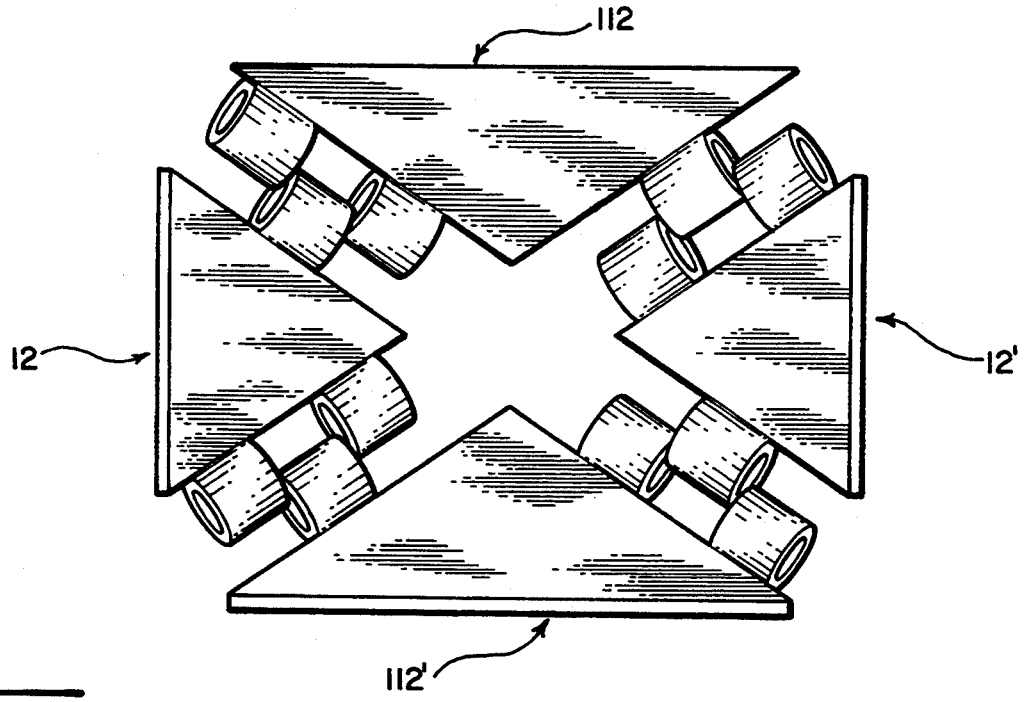
FIG. 7A is an exploded perspective view of four partially assembled, interlocking connectors using the connectors of FIGS. 1 and 6.
Figure 7B:
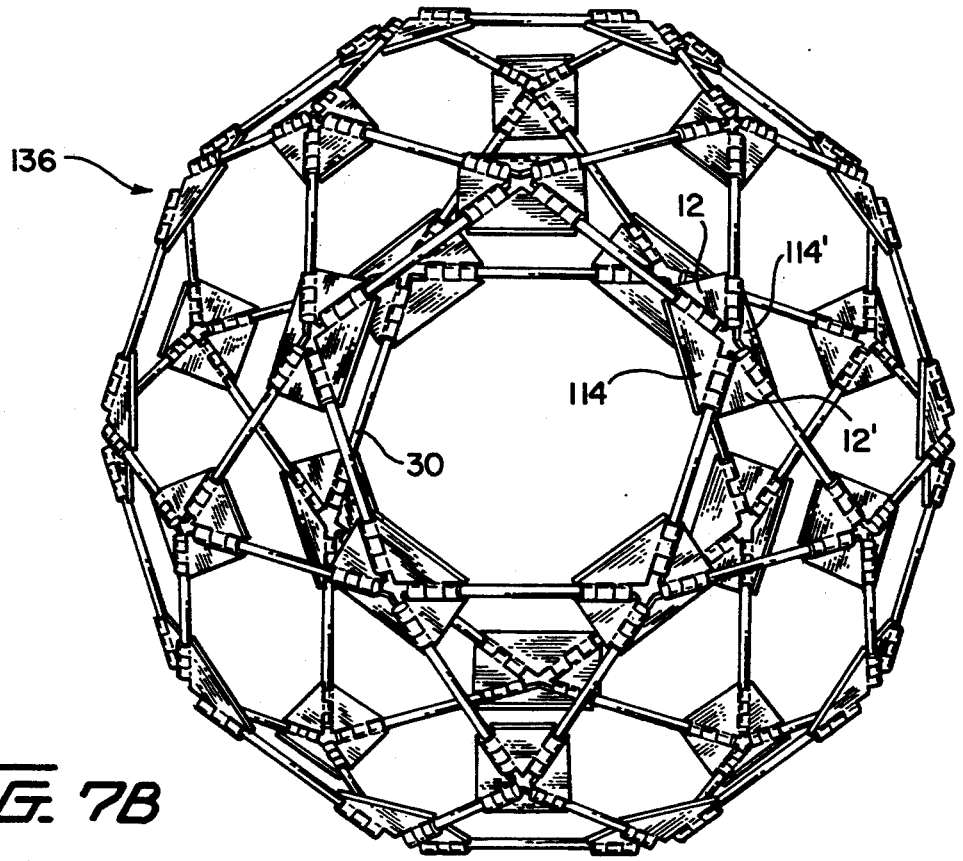
FIG. 7B is a perspective view of a 32-sided structure made using thirty of the connector assemblies depicted in FIG. 7A.

Secured to first side portion 116 is a first attaching element 124 having an associated first receiving opening 125. Second side portion 118 has attached thereto a pair of spaced attaching elements 126 and 128. Attaching elements 126 and 128 include respective receiving openings 127 and 129 which are axially aligned. As in the connector embodiment of FIG. 1, receiving opening 125 defines a longitudinal axis that intersects a longitudinal axis that extends through receiving openings 127 and 129 due to the convergence of side portions 116 and 118. Provided they are chosen to be of appropriate relative size, triangular connectors of the types depicted in FIGS. 1 and 6 can satisfy the intersecting axes relationship discussed above. If so, two of each type can be joined together, in a manner analogous to that discussed with reference to FIG. 5A, to form a joint for joining four rods that have a single converging vertex as depicted in FIG. 7A. Thirty such joints and their associated rods can then be combined to form the 32-sided latticework structure 136 shown in FIG. 7B.

Figure 8:
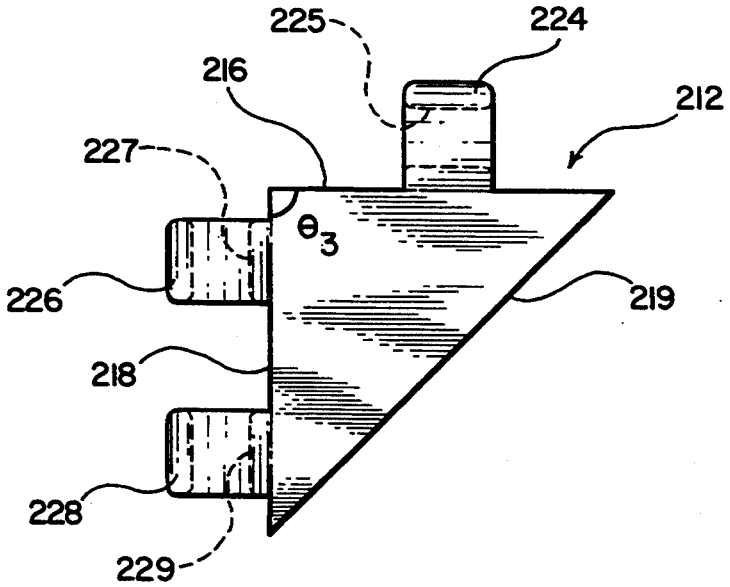
FIG. 8 is a plan view of a third connector embodiment according to the invention.
Figure 9:
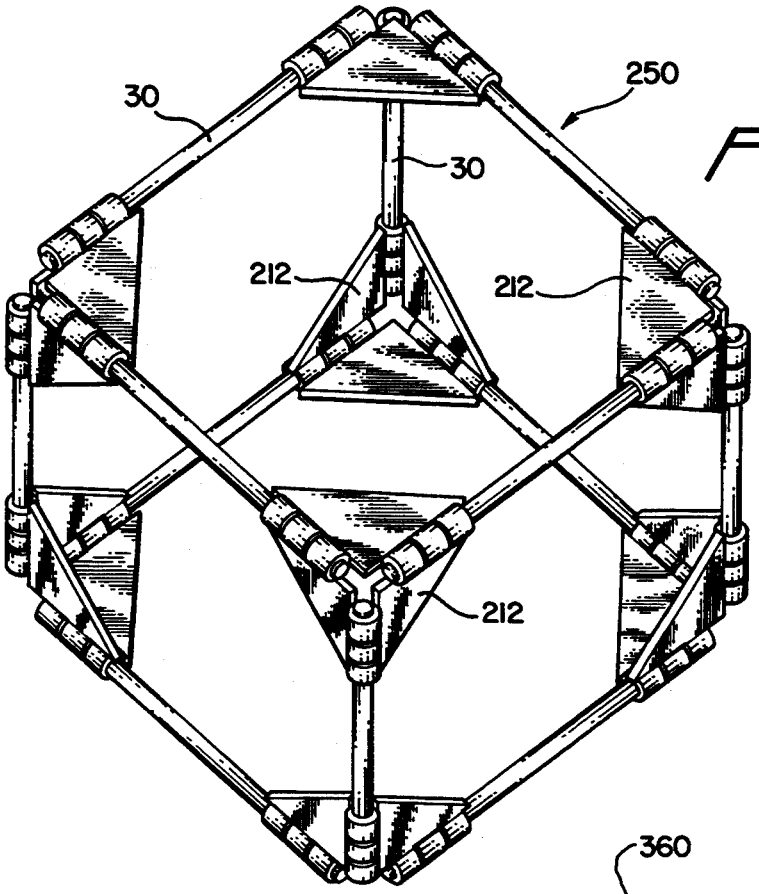
FIG. 9 is a perspective view of a cube made using the connectors of FIG. 8.

A third connector embodiment incorporated in the construction system of the present invention is depicted in FIG. 8 and referenced as 212. Connector 212 includes side portions 216, 218 and 219. Side portion 216 is provided with a first attaching element 224 having an associated receiving opening 225 that defines a longitudinal axis. In a similar manner, side portion 218 is provided with second and third, spaced attaching elements 226 and 228 having associated, axially aligned receiving openings 227 and 229 respectively. In this embodiment, side portions 21 6 and 218 converge to form an angle $\theta_3$ of 90°. Of course, angle $\theta_3$ also equals the angle defined at the intersection of the longitudinal axes defined by receiving openings 225 and 227, 229 respectively. As shown in FIG. 9, various connectors 212, along with numerous rods 30, can be used to form a cube-shaped latticework structure generally indicated at 250.

Figure 10:
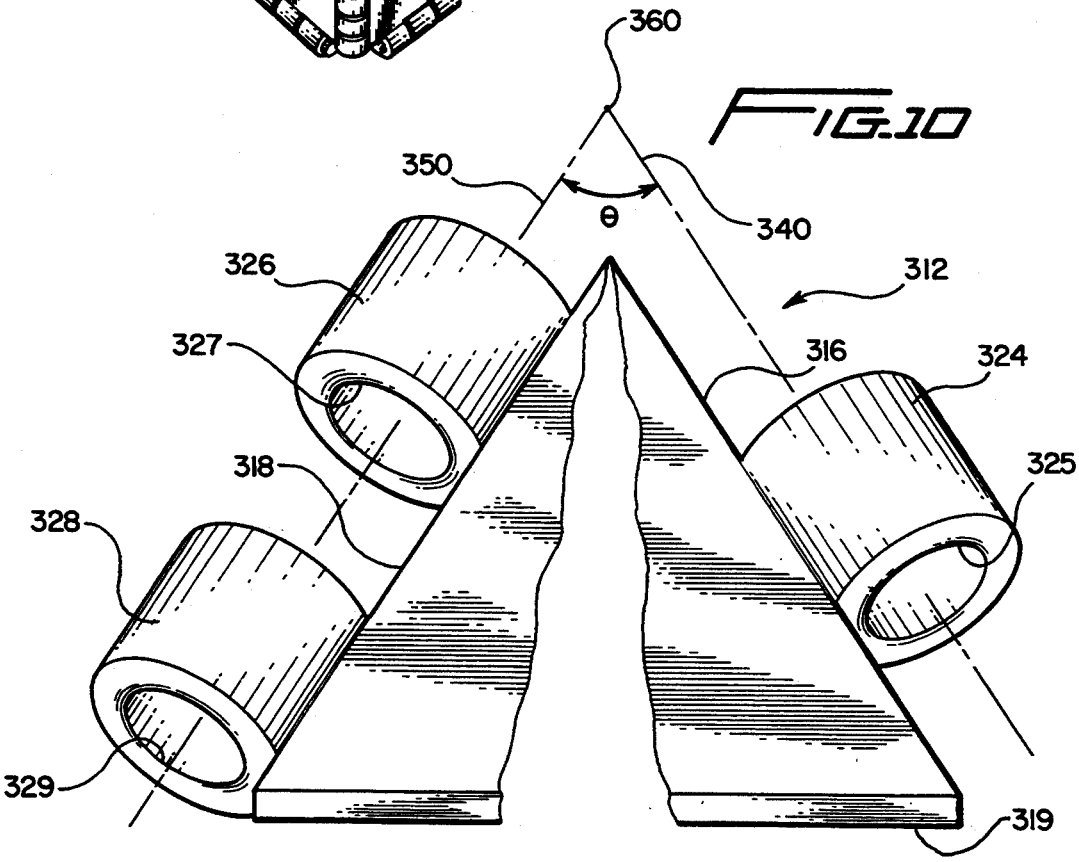
FIG. 10 is a partial perspective view illustrating a generic-type connector illustrating how the particular angle at the vertex of the converging axes of receiving openings associated with the attaching elements can be varied.

By this point, it should be apparent that the particular angle $\theta$ between the side portions of the connectors incorporated in the construction system of the invention can be varied without departing from the spirit of the invention. To illustrate this point, FIG. 10 is referenced as depicting a generic-type of connector 112 forming part of the construction system of the invention. As with the connector embodiments of FIGS. 1, 6 and 8, connector 312 includes side portions 316, 318 and 319 and attaching elements 324, 326 and 328. Attaching element 324 is provided along side portion 31 6 and attaching elements 326 and 328 are spaced along side portion 318. Receiving opening 325 associated with attaching element 324 has an associated longitudinal axis 340 that intersects a longitudinal axis 350 extending through aligned receiving openings 327 and 329 in attaching elements 326 and 328 respectively. Longitudinal axes 340 and 350 converge to a vertex 360 in space at a predetermined, wide ranging angle $\theta$. Of course, it should be recognized that vertex 360 actually represents a permissible zone of intersection given manufacturing tolerances between the interconnected rods and connectors. Vertex 360 defines the same converging vertex for each connector used in a single joint regardless of the connector's predetermined angle, provided its size is chosen appropriately relative to the other connectors in the joint. This characteristic enables varying shaped connectors to be readily interconnected to form various latticework structures such as those depicted in FIGS. 5B, 7 and 9.

Figure 11:
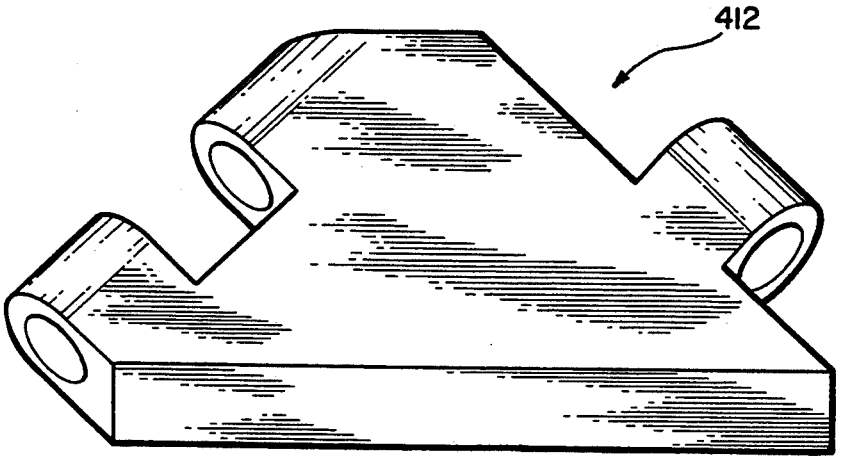
FIG. 11 shows a perspective view of a fourth, trapezoid-shaped connector embodiment with the attaching elements incorporated into the base plate.
Figure 12:
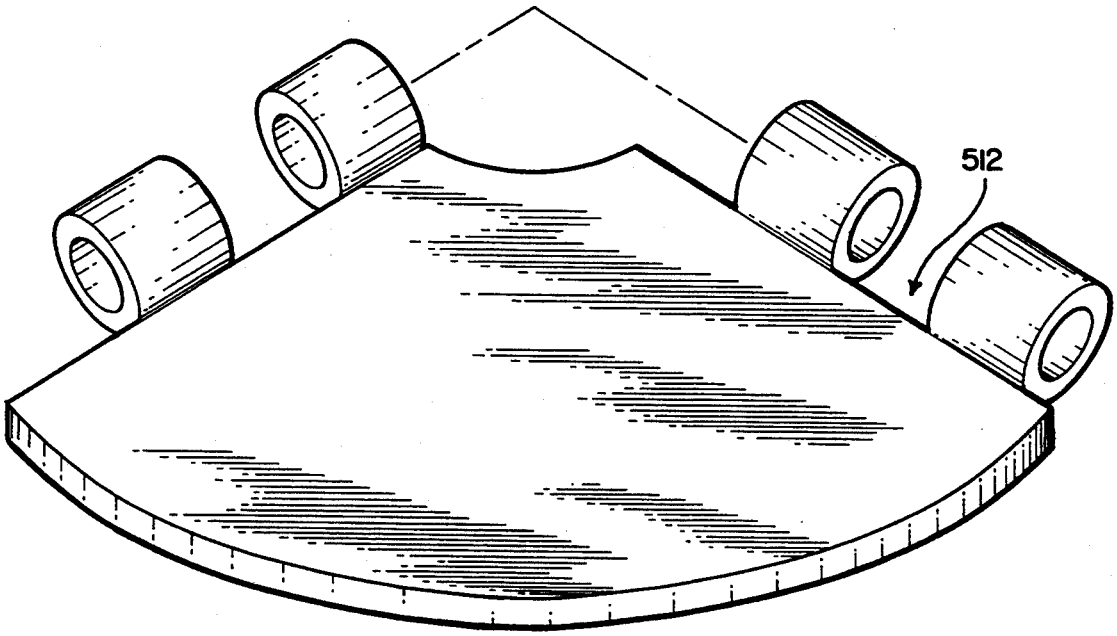
FIG. 12 shows a perspective view of a fifth, sector-shaped connector embodiment incorporating an additional attaching element.

So long as this criteria is met, connectors having a wide variety of shapes, sizes and predetermined angles associated therewith can be utilized and readily interconnected in accordance with the construction system of the present invention. Although connectors 12, 112 and 212 of FIGS. 1, 6 and 8 respectively have been depicted as triangular, various shaped connectors could be provided. For example, FIG. 11 depicts a connector 412 that is trapezoidal in shape and wherein the base portion has been thickened and the attaching members are integrally formed therewith, while FIG. 12 illustrates a connector 512 that defines a sector and has added a fourth attaching member, as might be desirable in applications requiring connectors of greater strength. In addition, in each of the drawings, the corresponding base member of each connector has been shown as having two straight side portions to which the attaching elements are secured. It must be kept in mind that these configurations are exemplary only. These members can be of practically any shape so long as they carry the required attaching elements and meet the desired intersecting criteria discussed above.

In the preferred embodiments discussed, the cross-section of each of the receiving openings of the attaching members have the same cross-section of the connecting rod placed through the openings. This need not be the case. The preferred embodiment of the construction system, as disclosed above, utilizes matching circular receiving openings and rods. This preferred arrangement aids in assembly of any given joint due to the permitted relative pivoting between the interconnected connectors. Of course, even with circular receiving openings and rods, once three connectors are interconnected, a substantially rigid joint is formed. However, if four or more connectors are assembled in this manner, relative pivoting will still be permitted. Of course, if relative pivoting were considered undesirable for a particular application, the receiving openings and rods can assume other polygonal cross-sections either over their entire lengths or simply at their associated connection locations.

Figure 13A:
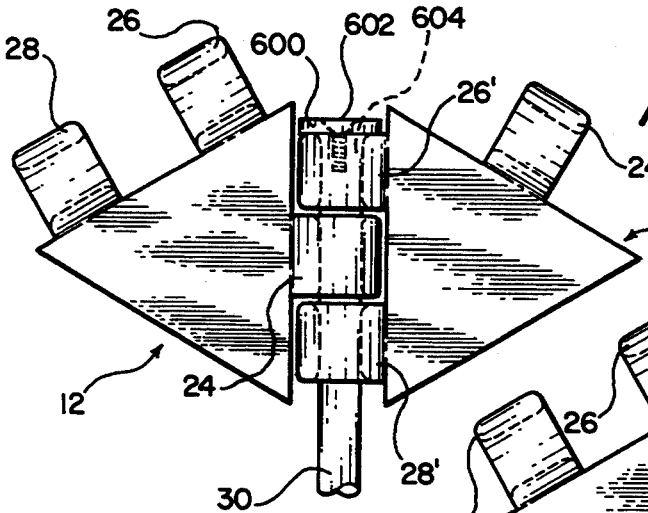
FIG. 13A is a plan view of a connector assembly similar to that shown in FIG. 4, further incorporating a retaining arrangement according to a first embodiment thereof.
Figure 13B:
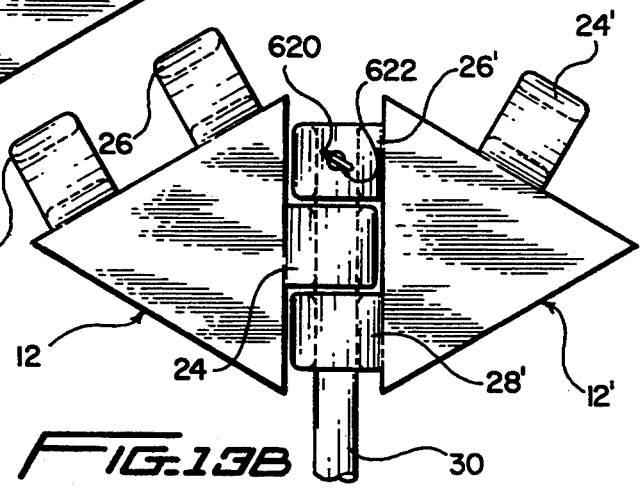
FIG. 13B is a plan view of a connector assembly similar to that shown in FIG. 4, further incorporating a retaining arrangement according to a second embodiment thereof.
Figure 13C:
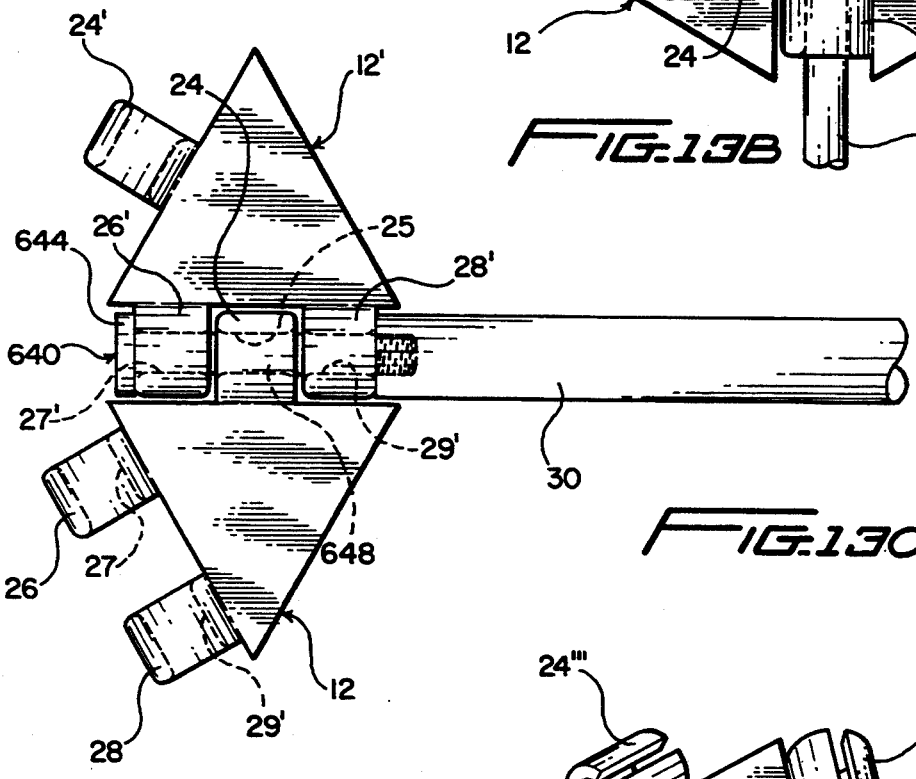
FIG. 13C is a plan view of a connector assembly similar to that shown in FIG. 4, further incorporating a retaining arrangement according to a third embodiment thereof.
Figure 13D:
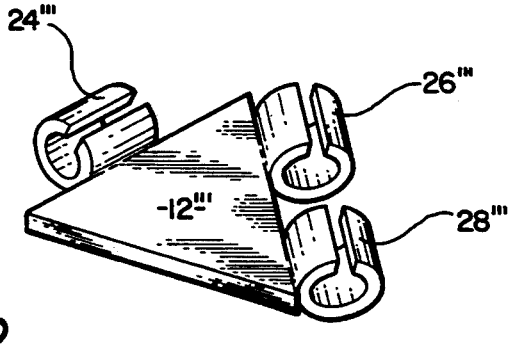
FIG. 13D is a perspective view of a connector similar to that shown in FIG. 1, further incorporating a retaining arrangement according to a fourth embodiment thereof.

In some applications, it may be preferred to prevent one or more of the connectors from shifting in one or more axial directions relative to its respective connecting rod. For this purpose, a retaining assembly can be utilized. One preferred retaining assembly embodiment according to the invention is depicted in FIG. 13A. In FIG. 13A, a retaining assembly including an end cap 600, such as a washer, is secured, by means of a screw 602 or other known fastener, into one end 604 of a rod 30 traveling through the attaching elements 24, 26' and 28' of connectors 12 and 12'. Obviously, this retainer embodiment prevents uni-directional axially shifting of connectors 12 and 12' relative to rod 30. FIG. 13B depicts a second retainer embodiment in which a cotter pin 620 is placed through an aligned aperture 622 in attaching member 26' and rod 30 of connector 12'. This arrangement prevents bi-directional shifting of attaching elements 12 and 12' along rod 30. As a third exemplary embodiment, an additional retaining assembly embodiment is shown in FIG. 13C. In this embodiment, a bolt 640 is provided that includes a head portion 644 and a shank portion 648. Shank portion 648 has an associated diameter slightly less that the diameters of receiving openings 25, 27' and 29' and travels through the receiving openings 25, 27' and 29' of connectors 12 and 12' and then screws into rod 30, which in this embodiment has a diameter larger than that of receiving opening 29', while head portion 644 abuts attaching element 26'. Although not shown in this drawing, head portion 644 is preferably formed with a receiving opening for an hex-shaped key, a screwdriver or the like for tightening purposes. Of course, head portion 644 could also be shaped to receive a socket wrench or other fastening tool. This retainer arrangement not only prevents axial sliding of connectors 12 and 12' relative to rod 30, but shank portion 648 of bolt 640 defines an extension of rod 30. As a final exemplary embodiment, an additional retaining method is shown in FIG. 13D. According to this embodiment, all attaching elements 24''', 26''' and 28''' on connector 12''' are split and constructed of a resilient material while their corresponding receiving openings 25''', 27''' and 29''' have a common diameter slightly smaller than the associated diameter of a rod adapted to extend therethrough. Nonetheless, the rod can be inserted into receiving openings 25''', 27''' and 29''' by springing open the attaching elements 24''', 26''' and 28''' slightly along their respective splits. The rod will then be held in place by the frictional force supplied by its contact under pressure with the internal walls of the various attaching elements. It should also be understood that there are many possible methods of inducing friction between the rod and the inner walls of the attaching elements, including the use of adhesives.

Figure 14:
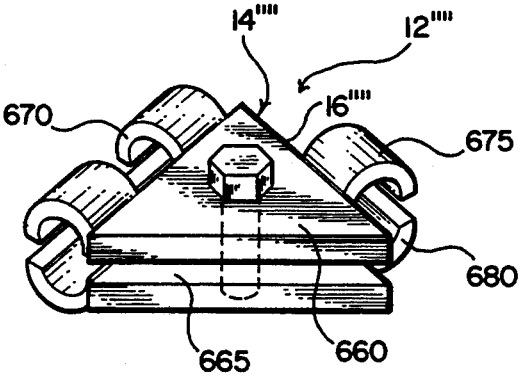
FIG. 14 depicts a fourth connector embodiment according to the present invention.

FIG. 14 depicts a still further connector 12'''' which can be utilized in the construction system of the invention. Connector 12'''' includes a split base portion 14'''' defined by two halves 660 and 665 which are interconnected by a suitable fastener 670, such as a bolt. Each half 660, 665 has secured on its associated side a segment of an overall attaching element. More specifically, by way of example, half 660 of connector 12'''' carries on side portion 16'''' an attaching segment 675. Attaching segment 675 defines an arcuate member which cooperates with a similarly constructed attaching segment 680 carried by half 665. According to this embodiment, connecting rods (not shown) may be placed between respective attaching segments and then bolt 670 may be threadably secured within half 665 in order to secure the rods in place by friction in a clamping arrangement.

Figure 15A:
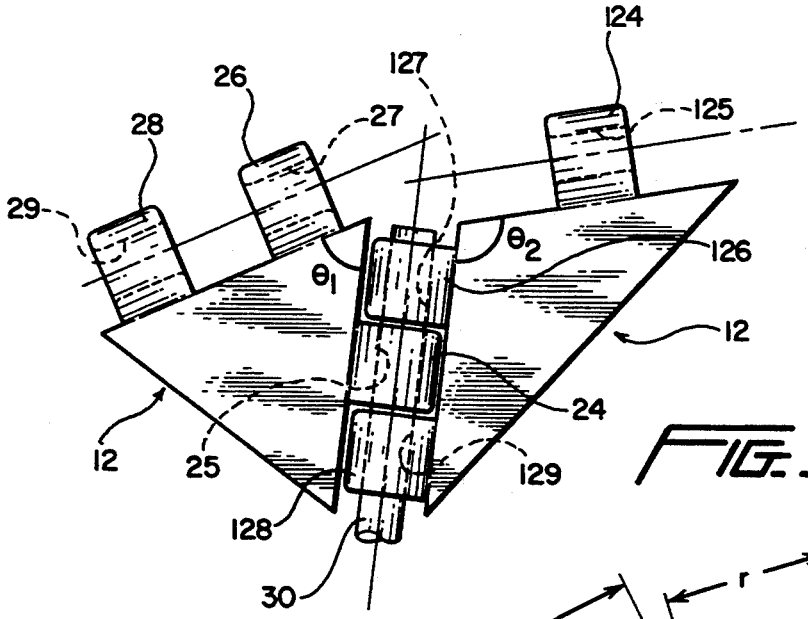
FIG. 15A is a plan view of two connectors, constructed in the manner shown in FIGS. 1 and 6, assembled together with a connecting rod.
Figure 15B:
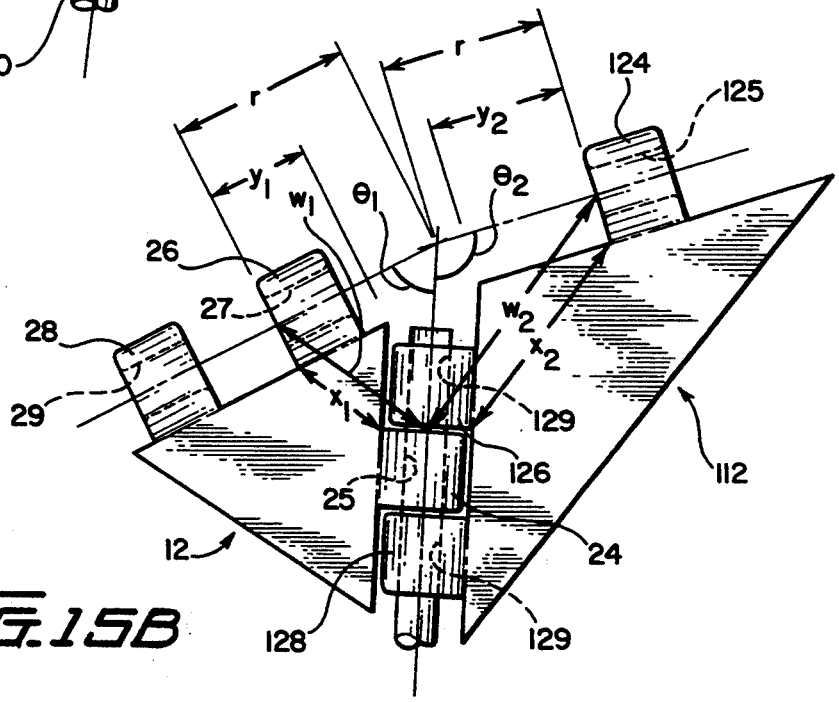
FIG. 15B is a plan view of two connectors, constructed in the manner shown in FIGS. 1 and 6, assembled together with a connecting rod as in FIG. 15A, but with different relative sizes of the connectors.

Finally, FIGS. 15A and 15B are presented to illustrate that two connectors may or may not have intersecting axes when joined depending on their relative sizes. FIG. 15A shows a plan view of a connector 12 joined by a rod 30 to a connector 112. However, the intersection of the longitudinal axis defined by receiving openings 27 and 29 with the longitudinal axis defined by receiving openings 25, 127 and 129 is not coincident with the intersection of the longitudinal axis defined by receiving opening 125 with the longitudinal axis defined by receiving openings 25, 127 and 129. FIG. 15B is identical to FIG. 15A with the exception that the dimensions of connector 112 have been increased relative to those of connector 12 so that the intersections of the longitudinal axes are now coincident. Thus, for a plurality of connectors with different predetermined angles to fit together to form a joint with a unique converging vertex, their relative sizes must be chosen properly. In general, for any two connectors with mutually intersecting axes as illustrated in FIG. 15B, the following relationships exist:

$$\mathrm{Sin}\left(\frac{\theta_2}{2}\right)=\frac{\left(\frac{w_1}{2}\right)}{r}=\frac{\left(\frac{x_1}{2}\right)}{y_1}\text{ and }\mathrm{Sin}\left(\frac{\theta_2}{2}\right)=\frac{\left(\frac{w_2}{2}\right)}{r}=\frac{\left(\frac{x_2}{2}\right)}{y_2};$$

$$w_1 = 2r\mathrm{Sin}\left(\frac{\theta_1}{2}\right)\text{and } w_2 = 2r\mathrm{Sin}\left(\frac{\theta_2}{2}\right);\text{ and}$$

$$x_1 = 2y_1\mathrm{Sin}\left(\frac{\theta_1}{2}\right)\text{and } x_2 = 2y_2\mathrm{Sin}\left(\frac{\theta_2}{2}\right).$$

$$\text{So: } w_2 = \frac{w_1\mathrm{Sin}\left(\frac{\theta_2}{2}\right)}{\mathrm{Sin}\left(\frac{\theta_1}{2}\right)}\text{ and }\frac{w_1y_1}{x_1}=\frac{w_2y_2}{x_2}.$$

Therefore, given various predetermined parameters associated with each connector, the remaining required values can be readily determined so that the joined connector can be properly, relatively sized.

While the present invention has been described with reference to preferred embodiments thereof, it is to be understood that various changes and/or modifications can be made without departing from the spirit of the invention. In general, the invention is only intended to be limited by the scope of the following claims.

I claim:

1. A construction system for making open lattice-work structures comprising:

a plurality of connectors, each of said connectors including a base portion, having opposing faces and at least first, a second and third side portions, and a plurality of attaching elements, said plurality of attaching elements including a first attaching element mounted on the first side portion of said base portion and a second attaching element mounted on the second side portion of said base portion, said first and second attaching elements respectively including first and second receiving openings each of which has an associated longitudinal axis, the longitudinal axis of said first receiving opening intersecting the longitudinal axis of said second receiving opening at a predetermined angle; and a plurality of rods, each of said rods defining a respective longitudinal axis and including first and second longitudinally spaced end portions, a first group of said plurality of connectors being interconnected by aligning the first receiving opening of a first connector of said first group of connectors with the second receiving opening of another connector of said first group of connectors and inserting the first end portion of a respective one of said plurality of rods within the aligned receiving openings to interconnect the first group of connectors, a second group of said plurality of connectors being interconnected by aligning the first receiving opening of a first connector of said second group of connectors with the second receiving opening of another connector of said second group of connectors and inserting the second end portion of the respective one of said plurality of rods within the aligned receiving openings to interconnect the second group of connectors, said first and second groups of connectors being spaced from each other along the longitudinal axis of the rod to form an open latticework structure.

2. A construction system according to claim 1, wherein said plurality of attaching elements further includes a third attaching element mounted on the second side portion of said base portion, said third attaching element being longitudinally spaced from said second attaching element.

3. A construction system according to claim 2, wherein said third attaching element includes a third receiving opening defining a longitudinal axis that is coincident with the longitudinal axis of said second receiving opening.

4. A construction system according to claim 3, wherein said first attaching element of any one of said plurality of connectors fits between the second and third attaching elements of another one of said plurality of connectors.

5. A construction system according to claim 4, wherein said first attaching element fits snugly between said second and third attaching elements.

6. A construction system according to claim 1, further including multiple categories of said plurality of connectors, each of the connectors in a first one of said categories having a first common said predetermined angle and each of the connectors in a second one of said categories having a second common said predetermined angle that is unequal to the first common predetermined angle.

7. A construction system according to claim 6, wherein the first common predetermined angle equals 60°.

8. A construction system according to claim 7, wherein the second common predetermined angle equals 90°.

9. A construction system according to claim 8, wherein a third one of said categories of said plurality of connectors has a third common said predetermined angle equal to 108°.

10. A construction system according to claim 1, further comprising means for retaining the first end portion of said respective one of said plurality of rods within said aligned receiving openings.

11. A construction system according to claim 10, wherein said means for retaining is secured to the first end portion of said respective one of said plurality of rods and prevents at least one of said plurality of interconnected connectors from moving axially relative to said respective one of said plurality of rods.

12. A construction system according to claim 11, wherein said means for retaining comprises an end cap fastened to the first end portion of said respective one of said plurality of rods.

13. A construction system according to claim 11, wherein said means for retaining comprises a cotter pin extending through one of said first and second attaching elements and said respective one of said plurality of rods.

14. A construction system according to claim 11, wherein said means for retaining comprises a bolt axially aligned with said respective one of said plurality of rods and screwed into the first end portion, said bolt including a shank adapted to extend within at least one of said first and second receiving openings.

15. A construction system according to claim 11, at least one of said first and second attaching elements defines a longitudinally split resilient member such that its associated one of said first and second receiving openings has a diameter that is slightly less than said respective one of said rods and said means for retaining comprises a frictional fit between said respective one of said plurality of rods and said at least one of said first and second attaching elements.

16. A construction system according to claim 1, wherein at least one of said plurality of connectors is split into two symmetrical halves, said two halves being interconnected by a bolt extending through one of said halves and being threadably secured to the other of said two halves.

17. A construction system according to claim 1, wherein said base portion is triangular in shape.

18. A construction system according to claim 1, wherein said attaching elements are tubular.

19. A construction system according to claim 18, wherein said attaching elements are of circular cross-section.

20. A construction system according to claim 1, wherein the longitudinal axes associated with each of the first and second receiving openings of any two of said plurality of connectors intersect at a common vertex when said connectors are interconnected by said respective one of said plurality of rods.

* * * * *